US009399308B2

(12) United States Patent
Fridlund

(10) Patent No.: US 9,399,308 B2
(45) Date of Patent: Jul. 26, 2016

(54) METHOD OF MAKING A FLOORBOARD

(75) Inventor: Magnus Fridlund, Tryggaröcl (SE)

(73) Assignee: TARKETT AB, Hanaskog (SE)

( * ) Notice: Subject to any disclaimer, the term of this patent is extended or adjusted under 35 U.S.C. 154(b) by 1992 days.

(21) Appl. No.: 12/294,896

(22) PCT Filed: Mar. 21, 2007

(86) PCT No.: PCT/SE2007/000271
§ 371 (c)(1),
(2), (4) Date: Jan. 10, 2011

(87) PCT Pub. No.: WO2007/111552
PCT Pub. Date: Oct. 4, 2007

(65) Prior Publication Data

US 2011/0114224 A1 May 19, 2011

(30) Foreign Application Priority Data

Mar. 27, 2006 (SE) ..... 0600680

(51) Int. Cl.
*B27F 1/06* (2006.01)
*B27M 3/04* (2006.01)
*E04F 15/02* (2006.01)

(52) U.S. Cl.
CPC .. *B27F 1/06* (2013.01); *B27M 3/04* (2013.01); *E04F 15/02* (2013.01); *E04F 15/02033* (2013.01); *E04F 2201/0153* (2013.01)

(58) Field of Classification Search
CPC ..... B27C 5/00; B27F 1/00; B27F 1/005; B27F 1/02; B27F 1/04; B27F 1/06; B27F 1/10; B27F 1/12; B27F 1/16; B05D 3/12; B05D 7/06; B05D 7/08; B05D 7/10; B05D 2501/00
USPC ..... 144/347, 350, 359, 363, 367, 376, 368, 144/371, 372, 377; 52/578, 588.1, 582.1, 52/589.1, 590.2, 591.1, 592.1, 747.1, 52/747.11; 29/897.32, 450, 453, 525; 427/289, 291, 393
See application file for complete search history.

(56) References Cited

U.S. PATENT DOCUMENTS 5,797,237 A * 8/1998 Finkell, Jr. ..... 52/589.1
2003/0024199 A1* 2/2003 Pervan et al. ..... 52/589.1
(Continued)

FOREIGN PATENT DOCUMENTS

EP 0906994 A1 4/1999
EP 1382773 A1 1/2004

OTHER PUBLICATIONS

International Search Report, mailed Jun. 14, 2007, for International Application No. PCT/SE2007/000271.

*Primary Examiner* — Matthew G Katcoff
(74) *Attorney, Agent, or Firm* — Finnegan, Henderson, Farabow, Garrett & Dunner, L.L.P.

(57) ABSTRACT

A floorboard (1), which along one long side has a female connecting means (2) and along its other long side has a male connecting member (4), is made of a raw board (18), which is substantially rectangular in cross-section. The raw board (18) has a carrier layer (14, 15) and, applied thereto, a wear layer (16). The raw board (18) is first subjected to limited profiling, which comprises the step of the surface layer (16) being provided with longitudinal edge bevels (17). After that, the surface layer (16) provided with edge bevels (17) is varnished. Finally the raw board (181) is subjected to final profiling intended for finishing of the connecting member (2, 4) and comprising the step of a downward and laterally open longitudinal recess (13) for receiving a connecting part (10) of the female connecting member (12) of another floorboard being formed under a connecting part (12) of the male connecting means (4).

3 Claims, 3 Drawing Sheets

(56) References Cited

U.S. PATENT DOCUMENTS

2004/0206036 A1* 10/2004 Pervan ..... A47G 27/0293
52/578
2005/0016099 A1 1/2005 Thiers
2005/0076598 A1 4/2005 Lewark
2005/0235593 A1* 10/2005 Hecht ..... B44C 5/043
52/592.1

* cited by examiner

METHOD OF MAKING A FLOORBOARD

This application is a national stage filing under 35 U.S.C. §371 of International Application No. PCT/SE2007/000271, filed on Mar. 21, 2007, which claims priority from Swedish Application No. 0600680-3, filed on Mar. 27, 2006.

FIELD OF THE INVENTION

The present invention relates to a method of making a floorboard with an elongated rectangular shape, said floorboard having a carrier layer and, applied to the top thereof, a wear layer which is provided with longitudinal edge bevels, and said floorboard having connecting means at its longitudinal side edges and being arranged to be connected to other identical floorboards to form a floor, which comprises a plurality of juxtaposed floorboards which are interconnected long side to long side, the connecting means consisting of a female connecting means and a male connecting means, which extend along one and respectively the other longitudinal side edge of the floorboard, the female connecting means having a first connecting part, which projects laterally from said one longitudinal side edge and extends along the same at a level below the upper surface of the floorboard and which has an upward open groove extending along the first connecting part, the male connecting means having a second connecting part, which extends along said other longitudinal side edge and under which is formed a downward and laterally open longitudinal recess, and when interconnecting two identical floorboards the second connecting part of one floorboard being inserted in the groove in the first connecting part of the other floorboard and said first connecting part being received in the longitudinal recess of said one floorboard, in which method the floorboard is made of a raw board, which is substantially rectangular in cross-section and which comprises a barrier layer and, applied to the top thereof, a wear layer, by profiling the raw board and varnishing its wear layer.

BACKGROUND ART

A prior art method of making a floorboard in the way stated above will now be described in more detail with reference to FIGS. 1-4 which illustrate a prior art floorboard of the type in which the method according to the invention can advantageously be used. FIG. 1 is a top plan view of the prior art floorboard, while FIGS. 2 and 3 illustrate the floorboard in cross-section and in longitudinal section respectively. FIG. 4 is a partial cross-sectional view and illustrates two floorboards according to FIGS. 1-3 connected to each other.

The floorboard 1 shown in FIGS. 1-3 is conventionally elongated and rectangular in shape. Floorboards of this type usually have a length of 1-2.6 m and a width of 100-200 mm. The floorboard 1 has at its four side edges connecting means 2, 3, 4, 5, which are arranged, when laying a floor, to cooperate with corresponding connecting means of other identical floorboards 1 in order to interconnect them. The floor consists of a plurality of neighbouring parallel rows of juxtaposed floorboards 1, the floorboards 1 of one row being interconnected short side to short side and the floorboards 1 of neighbouring rows being interconnected longside to longside, as shown in FIG. 4.

The connecting means 2-5 consist of a first pair of connecting means 2, 4, which consists of a female connecting means 2, which extends along one longitudinal side edge 6 of the floorboard 1, and a male connecting means 4, which extends along the other longitudinal side edge 7 of the floorboard 1, and a second pair of connecting means 3, 5, which consists of a female connecting means 3, which extends along one short side edge 8 of the floorboard 1, and a male connecting means 5, which extends along the other short side edge 9 of the floorboard 1.

The female connecting means 2, 3 in each pair of connecting means 2, 4 and 3, 5 has a first connecting part 10, which projects laterally from the side edge 6, 8 and extends along the same at a level below the upper surface of the floorboard 1. The first connecting part 10 has an upward open groove 11, which extends along the first connecting part.

The male connecting means 4, 5 in each pair of connecting means 2, 4 and 3, 5 has a second connecting part 12, which projects laterally from the side edge 5, 7 and extends along the same. A downward and laterally open longitudinal recess 13 is formed under the second connecting part 12.

For interconnection of two floorboards 1, the second connecting part 12 of the associated male connecting means 4 or 5 of one floorboard 1 is inserted in the groove 11 in the first connecting part 10 of the associated female connecting means 2 or 3 of the other floorboard 1, the first connecting part 10 being received in a corresponding recess 13 in the second connecting part 12, as shown in FIG. 4 for the connecting means 2 and 4 at the longitudinal side edges of the floorboards 1.

As is evident from FIGS. 2-4, the floorboard 1 is made up of three layers, viz. a carrier layer consisting of a bottom veneer layer 14 and an intermediate layer 15, and an upper wear layer 16. As is also illustrated, the wear layer 16 has an edge bevel 17 at each of its longitudinal side edges. The edge bevels 17 have an aesthetic purpose since they are to give the floor laid of the floorboard 1 a board-like structure and delimit the individual floorboards from each other in the lateral direction. The wear layer 16 provided with edge bevels 17 is varnished.

In the prior art method of making a floorboard of this type, one starts from a raw board, which is substantially rectangular in cross-section and which comprises a carrier layer 14, 15 and, applied to top thereof, a wear layer 16. In a first working step, the raw board is profiled for forming of connecting means 2-5 in the carrier layer 14, 15, at the longitudinal side edges as well as at the short side edges, and for bevelling of the wear layer 16 at its two longitudinal side edges. In a second working step, the profiled raw board is varnished by being passed on a conveyor belt through a plurality of varnishing stations and hardening stations, located between these varnishing stations, for hardening, for instance UV hardening, of the varnish or paint that has been applied. In each varnishing station, there are arranged an applicator roll for applying varnish/paint to the wear layer 16 and its edge bevels 17 and a counter roll which is placed under the conveyor belt.

This process of varnishing suffers, however, from the drawback that the varnish/paint is not applied in a homogeneous way to the wear layer 16, especially its edge bevels 17. In particular, there are difficulties in the corner area where the two male connecting means 4 and 5 of the floorboard 1 meet each other. In an attempt at eliminating these difficulties, separate edge bevel varnishing has been performed by means of applicator rolls in an additional varnishing plant between the two working steps described above, said application rolls being inclined according to the respective edge bevels. However, nor has this provided satisfactory varnishing results since a varnish/paint layer edge was obtained in the transition between the horizontal part of the wear layer 16 and the edge bevels 17. Moreover, the method is made more complicated and expensive by this additional varnishing plant.

SUMMARY OF THE INVENTION

The object of the present invention therefore is to provide a method of making a floorboard of the type described above, in which the above difficulties and drawbacks are eliminated.

In the method described by way of introduction, this object is achieved in that first the raw board is subjected to limited profiling, comprising the step of the surface layer being provided with longitudinal edge bevels at its longitudinal side edges, the surface layer provided with edge bevels is then varnished, and after that the raw board is subjected to final profiling intended for finishing of the connecting means, said final profiling comprising forming of the longitudinal recess at said other longitudinal side edge.

The limited profiling preferably also comprises partial forming of the first connecting part.

The final profiling advantageously also comprises the step of a female connecting means and a male connecting means being formed at one and respectively the other short side edge of the floorboard.

BRIEF DESCRIPTION OF THE DRAWINGS

The method according to the present invention will now be described in more detail with reference to the accompanying drawings.

(FIG. 9 is identical to FIG. 2).

(FIG. 10 is identical to FIG. 3).

DESCRIPTION OF A PREFERRED EMBODIMENT OF THE INVENTION

Figure 1:
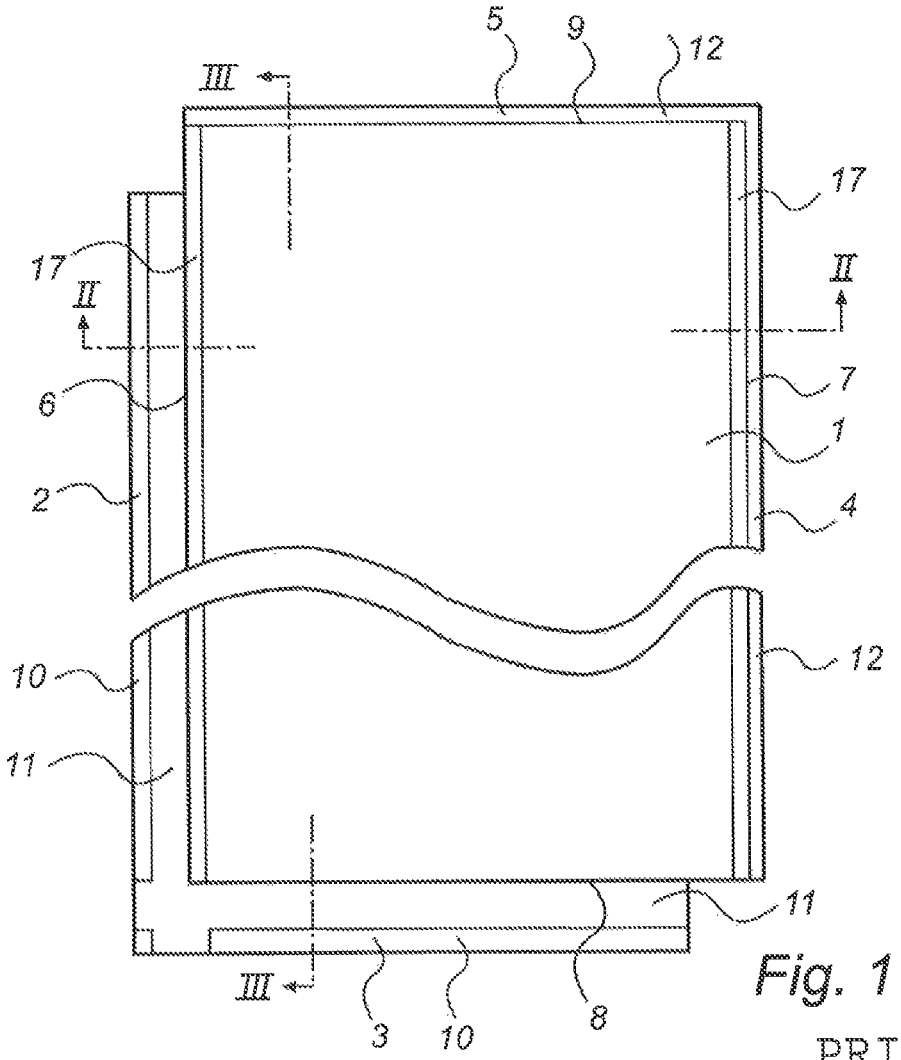
Fig. 1 PRIOR ART
FIG. 1 is a top plan view of the prior art floorboard described above.
Figure 2:
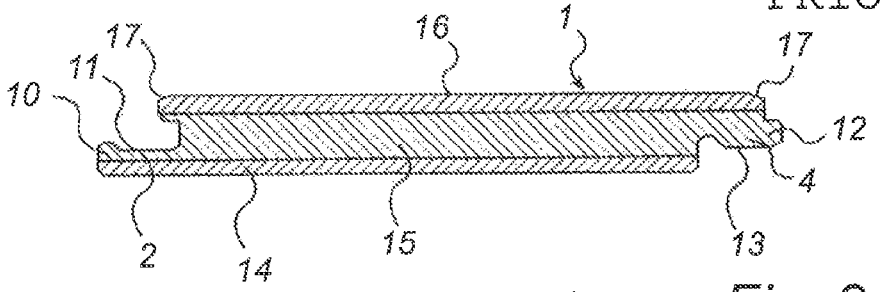
Fig. 2 PRIOR ART
FIG. 2 illustrates the floorboard according to FIG. 1 in cross-section along the line II-II in FIG. 1.
Figure 4:
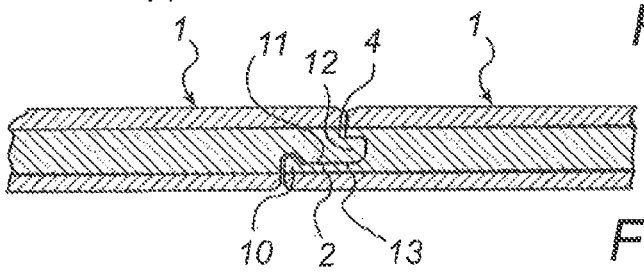
Fig. 4 PRIOR ART
FIG. 4 is a partial cross-sectional view and illustrates two floorboards according to FIGS. 1-3 connected to each other for making a floor.
Figure 3:
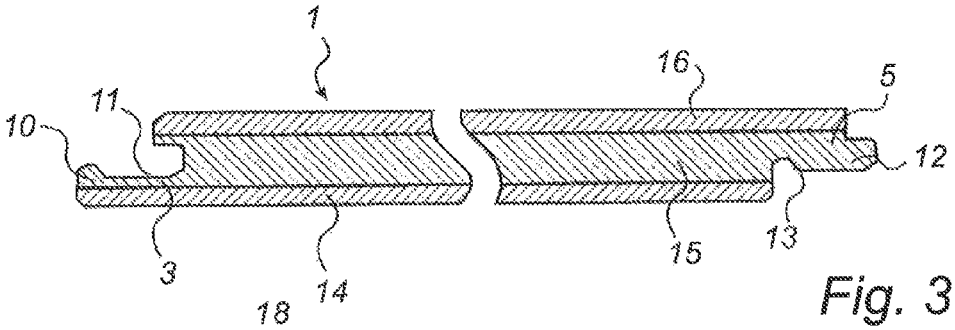
Fig. 3 PRIOR ART
FIG. 3 illustrates the floorboard according to FIG. 1 in longitudinal section along the line III-III in FIG. 1.
Figure 6:
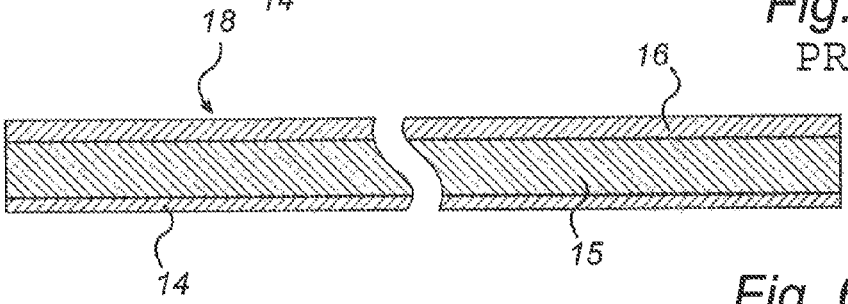
FIG. 6 illustrates the raw board according to FIG. 5 in longitudinal section.
Figure 5:
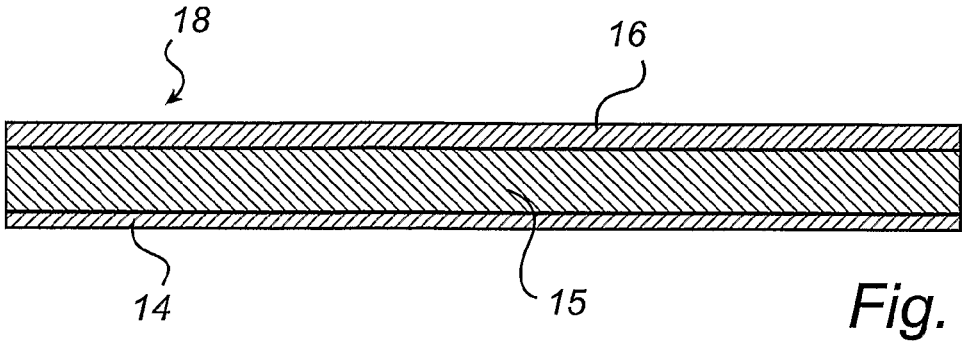
FIG. 5 is a cross-sectional view and shows a raw board for making a floorboard according to FIGS. 1-3.

In a method of making the floorboard 1, shown in FIGS. 1-3 and described above, according to the present invention, use is made of a raw board 18 which is shown in FIGS. 5 and 6. The raw board 18 is substantially rectangular in cross-section and is made of three layers, viz. a bottom veneer layer 14, an intermediate layer 15 and an upper wear layer 16. The layers 14 and 15 together form a carrier layer.

Figure 8:
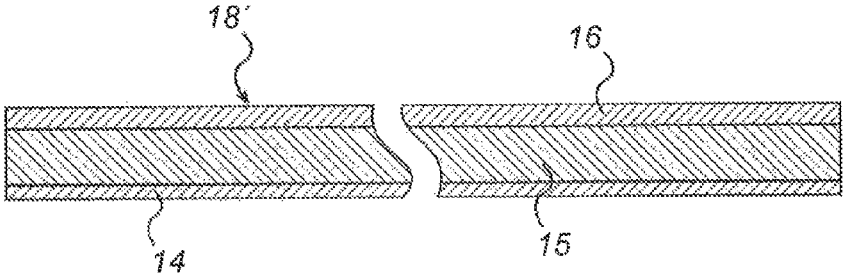
FIG. 8 is a longitudinal sectional view and shows the raw board after the limited profiling.
Figure 10:
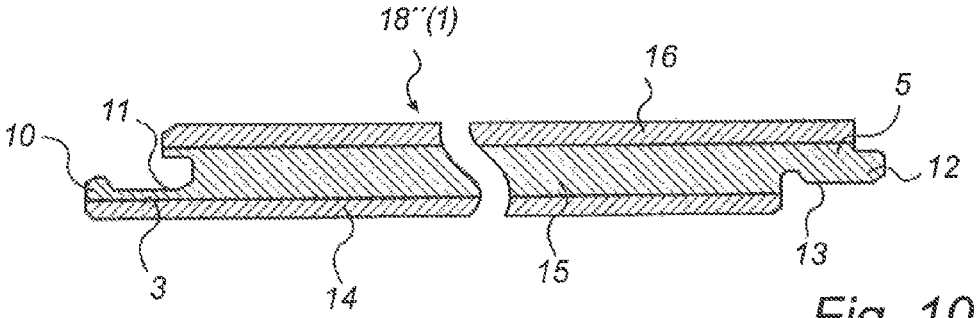
FIG. 10 is a longitudinal sectional view and shows the raw board after the final profiling
Figure 7:
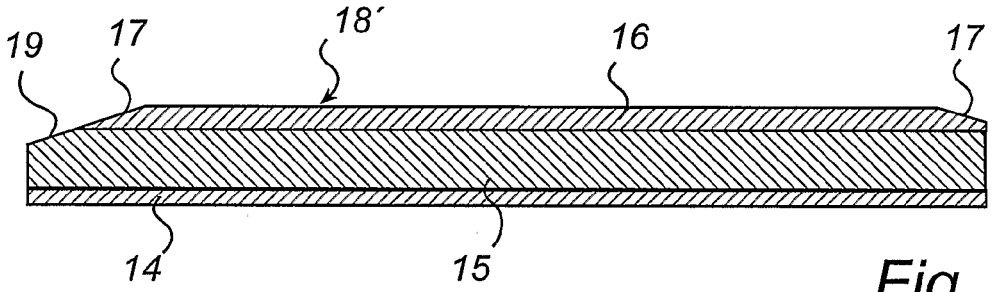
FIG. 7 is a cross-sectional view and shows the raw board after limited profiling.
Figure 9:
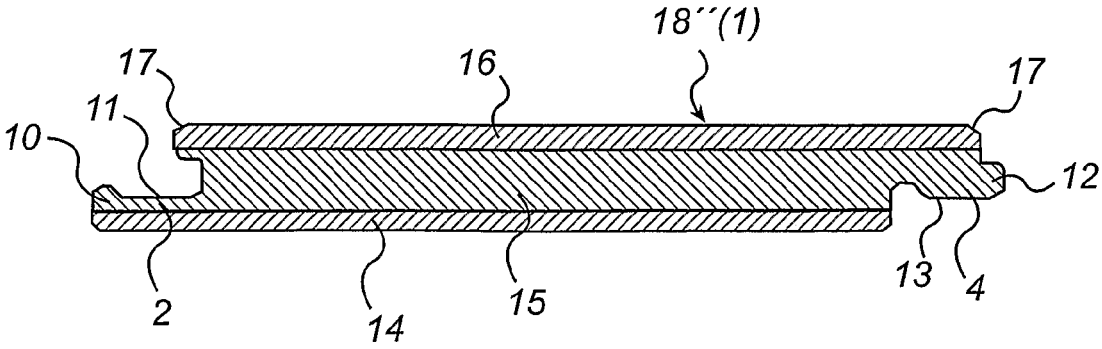
FIG. 9 is a cross-sectional view and shows the raw board after final profiling, that is it shows the manufactured floorboard

The raw board 18 is first subjected to limited profiling, in which the wear layer 16 in a milling or planing operation or the like is provided with longitudinal edge bevels 17 at its longitudinal side edges and is given the appearance shown in FIGS. 7 and 8. The intermediate layer 15 of the raw board 18 is, as shown in FIG. 7, at one longitudinal side edge also provided with a longitudinal edge bevel 19, which is a direct continuation of the edge bevel 17 at this long side. This profiling of the intermediate layer 15 can be said to be an introductory partial forming of the first connecting part 10 of the female connecting means 2. This partial forming of the first connecting part 10, which is included in the limited profiling of the raw board 18, can be more extensive and comprise, for instance, additional profiling for more or less complete forming of the first connecting part 10 included in the female connecting means 2 and formed with the groove 11. A corresponding partial, more or less complete forming (not shown in FIG. 8) of the connecting part 10 included in the female connecting means 3 and formed with the groove 11 can also be performed during the limited profiling.

Subsequently the raw board 18' subjected to the limited profiling as described above is varnished. The varnishing operation is preferably performed in the above described prior art manner by the raw board 18' being passed through a plurality of varnishing stations for varnishing of the wear layer 16 and its edge bevels 17 and through hardening stations, positioned between these varnishing stations, for hardening, for instance UV hardening, of the varnish or paint that has been applied. Varnishing is advantageously carried out in an existing prior art varnishing plant of the type described above.

The varnished raw board 18' is then subjected to final profiling intended for finishing of all connecting means 2-5, said final profiling especially comprising forming of the recess 13 in the second connecting part 12 of the male connecting means 4 and, if a male connecting means 5 is also formed, also in the second connecting part 12 thereof, the raw board 18" having, after final profiling, a shape that is identical to that of the floorboard 1.

It has been found that the above described difficulties and drawbacks are eliminated when the floorboard 1 is made in this way.

The invention claimed is:

1. A method of producing an elongate rectangular floorboard provided with a female connector having a first connecting part projecting laterally from a first long side edge of the floorboard, the first connecting part extending along the first long side edge of the floorboard at a level below an upper surface of the floorboard and having an upward open groove; and a male connector having a second connecting part extending along a second long side edge of the floorboard and under which is formed a downward and laterally open longitudinal recess, the recess shaped to receive a first connecting part of an identical, adjacent floorboard and the groove shaped to receive a second connecting part of another identical, adjacent floorboard thereby allowing forming a floor of juxtaposed identical floorboards, said method comprising:

providing a raw board to be used as workpiece for forming the floorboard, the raw board having a substantially rectangular cross-section and comprising a carrier layer, and an upper wear layer on top of the carrier layer;

subjecting the raw board to limited profiling by providing the wear layer with a first longitudinal edge bevel at a first long side edge of the raw board, a second longitudinal edge bevel at a second long side of the raw board, and by providing the carrier layer with a longitudinal carrier layer edge bevel, which is a direct continuation of the first longitudinal edge bevel at the first long side of the raw board, wherein the first connecting part is partially formed by said limited profiling at the first long side edge of the raw board;

varnishing the wear layer including the first and second longitudinal edge bevels of the wear layer; and thereafter, subjecting the raw board to final profiling for finishing of the female connector and the male connector of the floorboard, wherein said final profiling comprises removing the longitudinal carrier layer edge bevel at the first long side edge of the raw board and profiling the second long side edge of the raw board to form the longitudinal recess along the second long side edge of the floorboard.

2. A method as claimed in claim 1, in which the final profiling also comprises the step of forming an additional female connector at a first short side edge of the raw board and an additional male connector at a second short side edge of the raw board.

3. A method of producing an elongate rectangular floorboard with beveled long side edges, the method comprising:

providing a raw board to be used as workpiece for forming the floorboard, the raw board having a pair of mutually opposing first and second long side edges and a pair of mutually opposing first and second short side edges, the raw board comprising a carrier layer, and an upper wear layer on top of the carrier layer;

providing the wear layer with first and second longitudinal edge bevels at the first and second long side edges, respectively, and providing the carrier layer with a longitudinal carrier layer edge bevel, which is a direct continuation of the first longitudinal edge bevel at the first long side of the raw board, thereby obtaining said beveled long side edges;

varnishing the wear layer including the first and second edge bevels of the wear layer; and thereafter, profiling each of said first and second long side edges to form a respective connector allowing interconnecting the floorboard with an adjacent, identical floorboard, wherein said profiling comprises removing the longitudinal carrier layer edge bevel.

* * * * *